US005431122A

United States Patent [19]

Templet, Jr.

[11] Patent Number: 5,431,122

[45] Date of Patent: Jul. 11, 1995

[54] APPARATUS FOR CLEANING THE SUBMERGED PORTION OF SHIP HULLS

[76] Inventor: John A. Templet, Jr., P.O. Box 1102, Pascagoula, Miss. 39567

[21] Appl. No.: 979,421

[22] Filed: Nov. 19, 1992

Related U.S. Application Data

[63] Continuation of Ser. No. 706,931, May 29, 1991, abandoned.

[51] Int. Cl.[6] ..... B63B 59/00

[52] U.S. Cl. ..... 114/222

[58] Field of Search ..... 114/222; 15/93.1; 299/37

[56] References Cited

U.S. PATENT DOCUMENTS 4,697,536 10/1987 Hirata ..... 114/222

FOREIGN PATENT DOCUMENTS 8403869 10/1984 WIPO ..... 114/222

*Primary Examiner*—Sherman Basinger

*Attorney, Agent, or Firm*—Pravel, Hewitt, Kimball & Krieger

[57] ABSTRACT

An apparatus for cleaning ship hulls underwater. A frame is supported by controlled buoyancy tanks which may be flooded to sink the apparatus beneath a ship, blown to a neutral buoyancy for easy underwater maneuvering, or blown to a positive buoyancy so to adhere against the inverted hull of a ship. The apparatus, when underwater against a hull, rides on two independently powered wheels which are individually driven by hydraulic motors for individual control by the diver. These wheels, extending above the upper surface of the apparatus in its submerged position, engage the hull, driving the apparatus along the hull. At the forward end of the apparatus is a reciprocating chipper blade, an angled or concave, hardened steel blade driven by a vibratory impact apparatus at a high repetition rate through a very short stroke. The distance of the stroke and the speed of the blade is such that the impact of the blade cleans the hull of the barnacles, but does not exert a rearward force which would overcome the traction of the wheels. The apparatus will clean the hull of marine growth, but does no damage to the hull or to the paint on the hull.

15 Claims, 5 Drawing Sheets

APPARATUS FOR CLEANING THE SUBMERGED PORTION OF SHIP HULLS

This is a continuation of application Ser. No. 07/706,931, filed on May 29, 1991, now abandoned.

BACKGROUND OF THE INVENTION

This invention relates to apparatus for cleaning the submerged portion of ship hulls, specifically for removing barnacles and marine growth from ship hulls, especially painted metal hulls without damage to the hull.

It is well known that any object immersed in the ocean attracts various forms of marine organisms which settle and grow on its surface. This significantly affects ships in maritime commerce, which are significantly affected by hull form degradation form the growth of such organisms. The most deleterious such organisms are barnacles, hard shelled marine organisms which form an irregular, high drag growth upon the surface of the hull, significantly reducing the efficiency of ship operation and increasing the cost of such operation. Barnacles form a strong calcerous bond to any submerged object, and grow hard calcium based shell structures, which are extremely resistant to abrasion. Removal of such growth without damage to the ship hull is a difficult task.

In large ocean going vessels, for example tankers, the economics of vessel operation are such that it is prohibitively expensive to periodically dry dock the ship for cleaning and scraping; nonetheless marine growth must be periodically removed from the hull so as to prevent nonacceptable degradation in ship performance. For this reason there has been a long felt need for an apparatus which is capable of removing marine organisms and barnacle growth from a hull while the ship is in the water. Further, such an apparatus must effectively smooth the hull without removing protective paint and without damaging the hull.

The prior art apparatus for this purpose is complicated by the underwater environment. Since there is generally no surface against which such a unit can be braced or push for positioning or stability, the nature of the cleaning forces is limited to such forces as will not push the apparatus away from the hull. For this reason, the prior art has developed various forms of counterrotating brushes or rotating abraders, which do not produce significant net reactive forces in use, and thus do not push themselves away form the work.

SUMMARY OF THE INVENTION

The invention discloses a diver operated controlled buoyancy apparatus which may be driven by a diver along the underside of a ship hull and which has a unique cleaning action which cleanly and effectively removes barnacles and marine growth from the hull efficiently and with minimum damage to the hull and paint.

The apparatus briefly consists of a cage having controlled buoyancy tanks which may be flooded to sink the apparatus beneath the hull, or may be blown to bring the apparatus to a neutral bouyancy for easy underwater manuvering or to a slightly positive buoyancy so as to cause it to adhere against the inverted hull of a ship.

The cage, when underwater against a hull, rides on two independently powered tires or wheels which may be either pneumatic, water filled or solid and which are individually driven by hydraulic motors and individually controlled by the diver. These wheels, extending above the upper surface of the apparatus in its submerged position, frictionally engage the hull, driving the apparatus along the hull.

At the forward end of the apparatus is a reciprocating chipper blade, an angled or concave, hardened steel blade mounted and supported for reciprocating motion with respect to the cage. The blade is driven by a vibratory impact apparatus at a high repetition rate through a very short stroke. The distance of the stroke and the speed of the blade is such that the impact of the blade upon the barnacles does not exert so excessive a rearward force as to overcome the traction of the wheels.

Thus the apparatus may be driven forward, pushing the reciprocating blade along the surface of the hull. The high speed, short stroke impact of the blade cleanly separates barnacles and other adhering materials from the hull, producing a smooth uniformly clean surface in a single pass along the hull. The inventive apparatus cleans at a rate of speed higher than that of the prior art rotary brushes and abraders.

The apparatus is sized so that it may be easily maneuvered and utilized by a single diver who swims behind or below the apparatus as needed to obtain a clear view of the path cleaned and the hull ahead of the apparatus. Where the water is sufficiently clean for good viewing, the diver may sit or stand upon a supporting bar at the aft end of the apparatus, and is carried along with the apparatus.

The diver, by control of the buoyancy tank and control of the hydraulic motors driving the wheels, is able to sink or surface the apparatus against the hull and is able to drive the apparatus along the hull, controlling its direction easily as it scrapes the hull clean.

It is thus an object of this invention to disclose a ship hull cleaning apparatus which may be readily utilized by a diver to clean barnacles and marine growth from a ship hull in water.

It is a further object of this invention to show an apparatus which is capable of cleaning a ship hull to a smoother surface than abrading brushes.

It is a further object of this invention to disclose a ship cleaning apparatus which can clean a hull under water at a more efficient rate of speed.

It is a further object of this invention to disclose a ship cleaning apparatus which permits a single diver to readily and speedily clean a large ocean going ship hull in a quickly enough period of time to permit cleaning of the ship hull during normal port turnaround operations.

It is a further object of this invention to disclose an apparatus which has a significantly increased efficiency of ship hull cleaning for in-water ships. These and other objects of the invention may be more readily disclosed in the detailed description of the preferred embodiment which follows.

DETAILED DESCRIPTION OF THE PREFERRED EMBODIMENT

Figure 1:
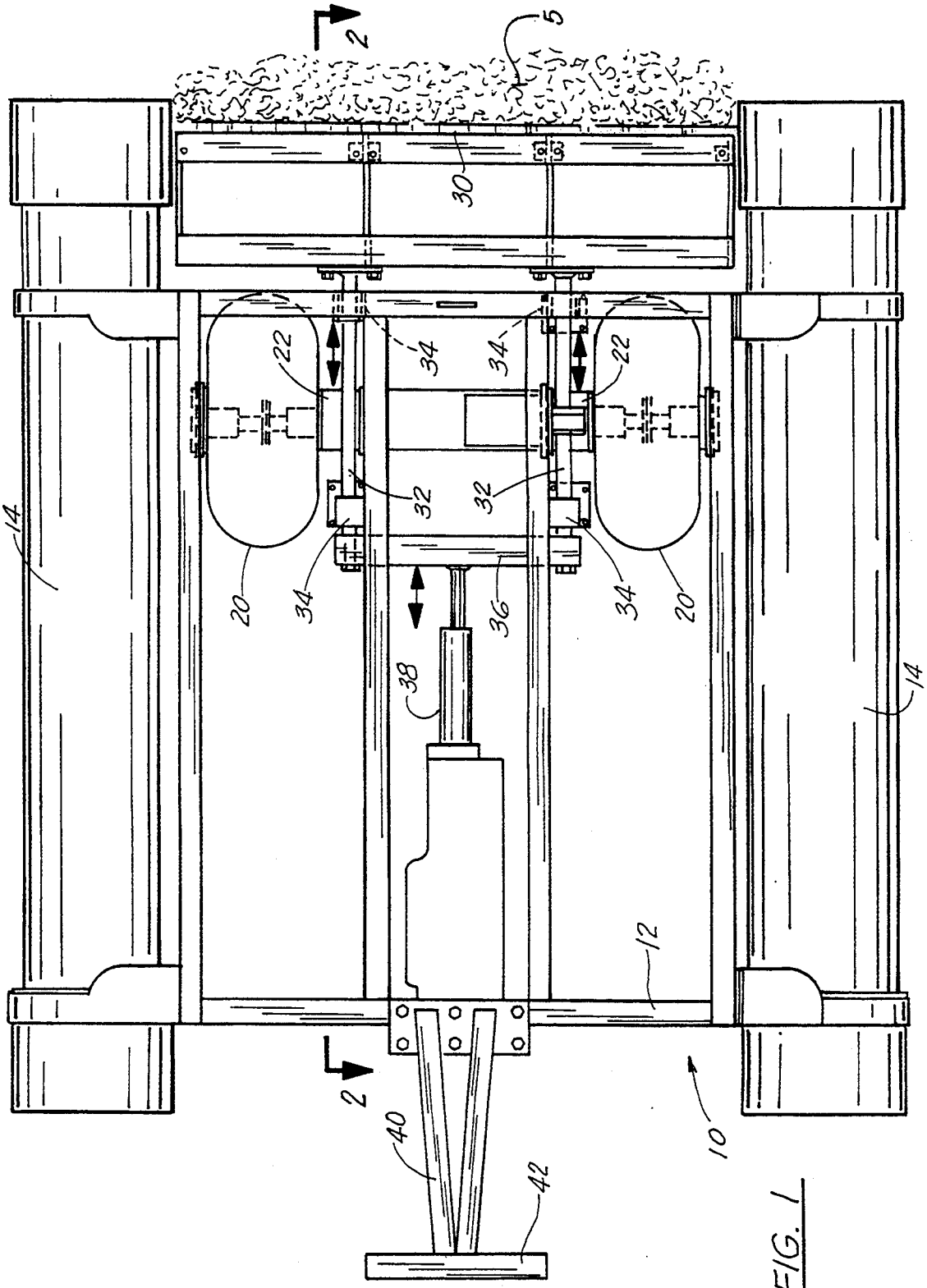
FIG. 1 is a view looking up from the bottom of the apparatus as it cleans a hull.
Figure 2:
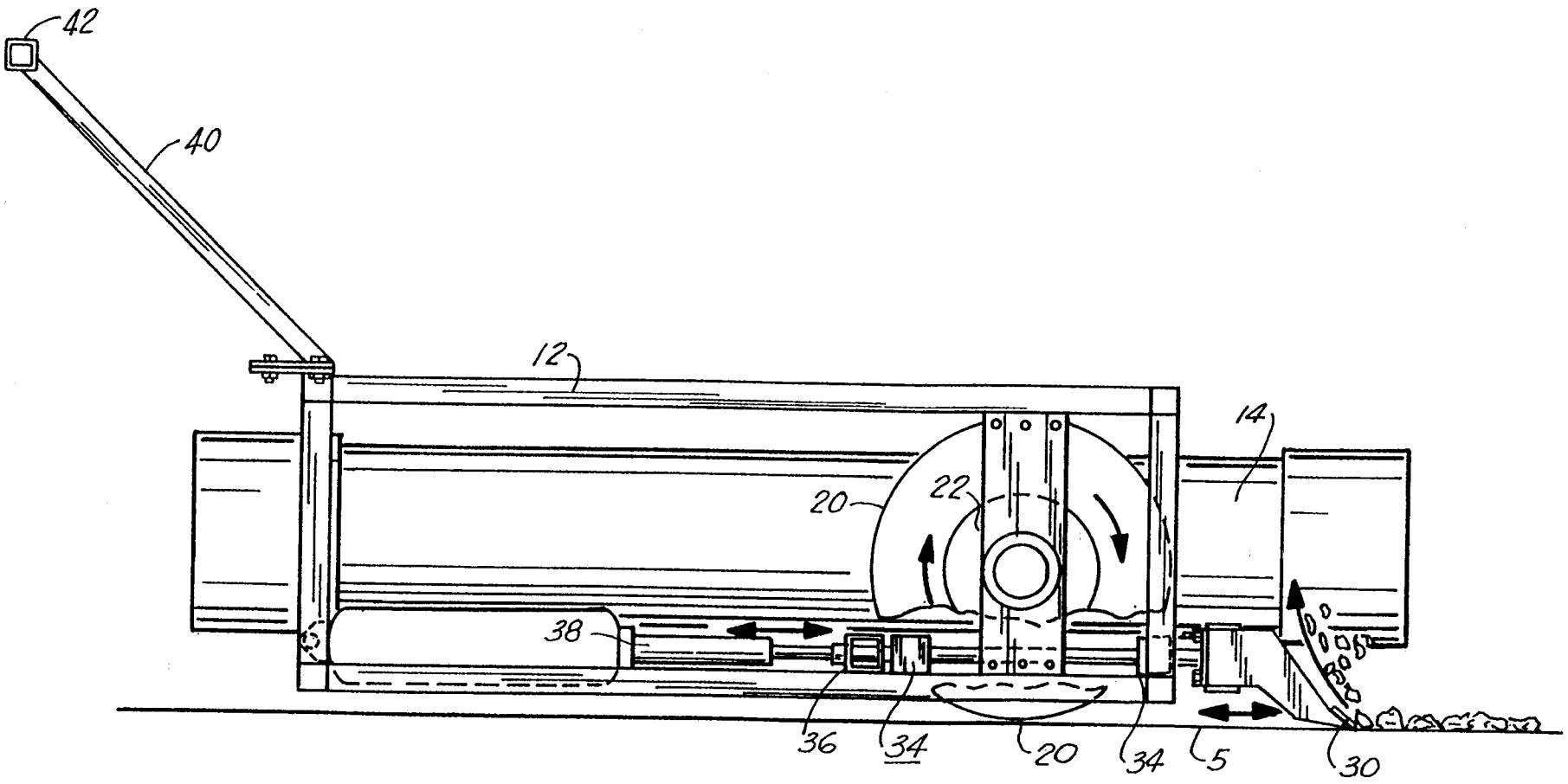
FIG. 2 is a side view of the apparatus.
Figure 3:
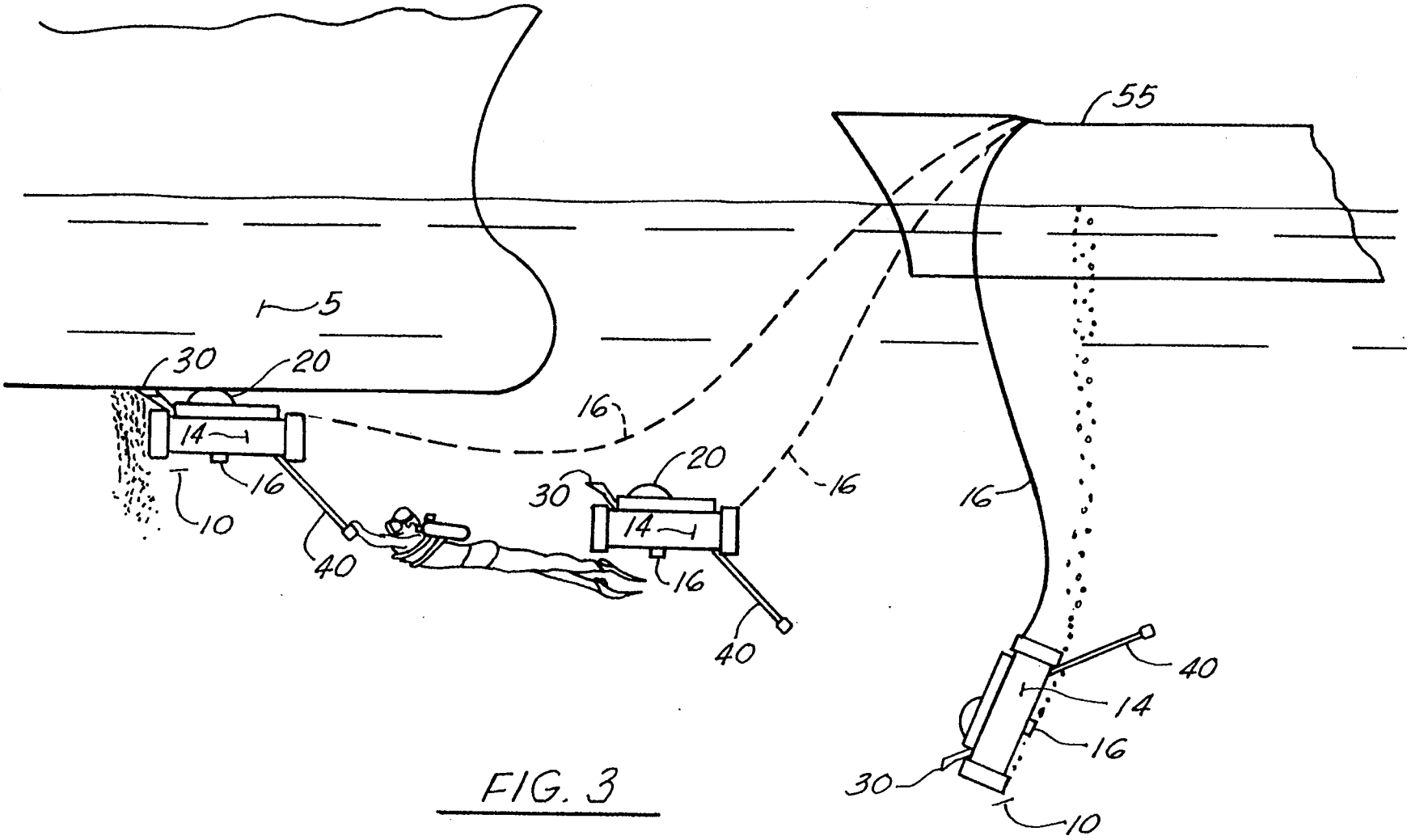
FIG. 3 is a figurative view of the apparatus being placed for working a ship hull.
Figure 4:
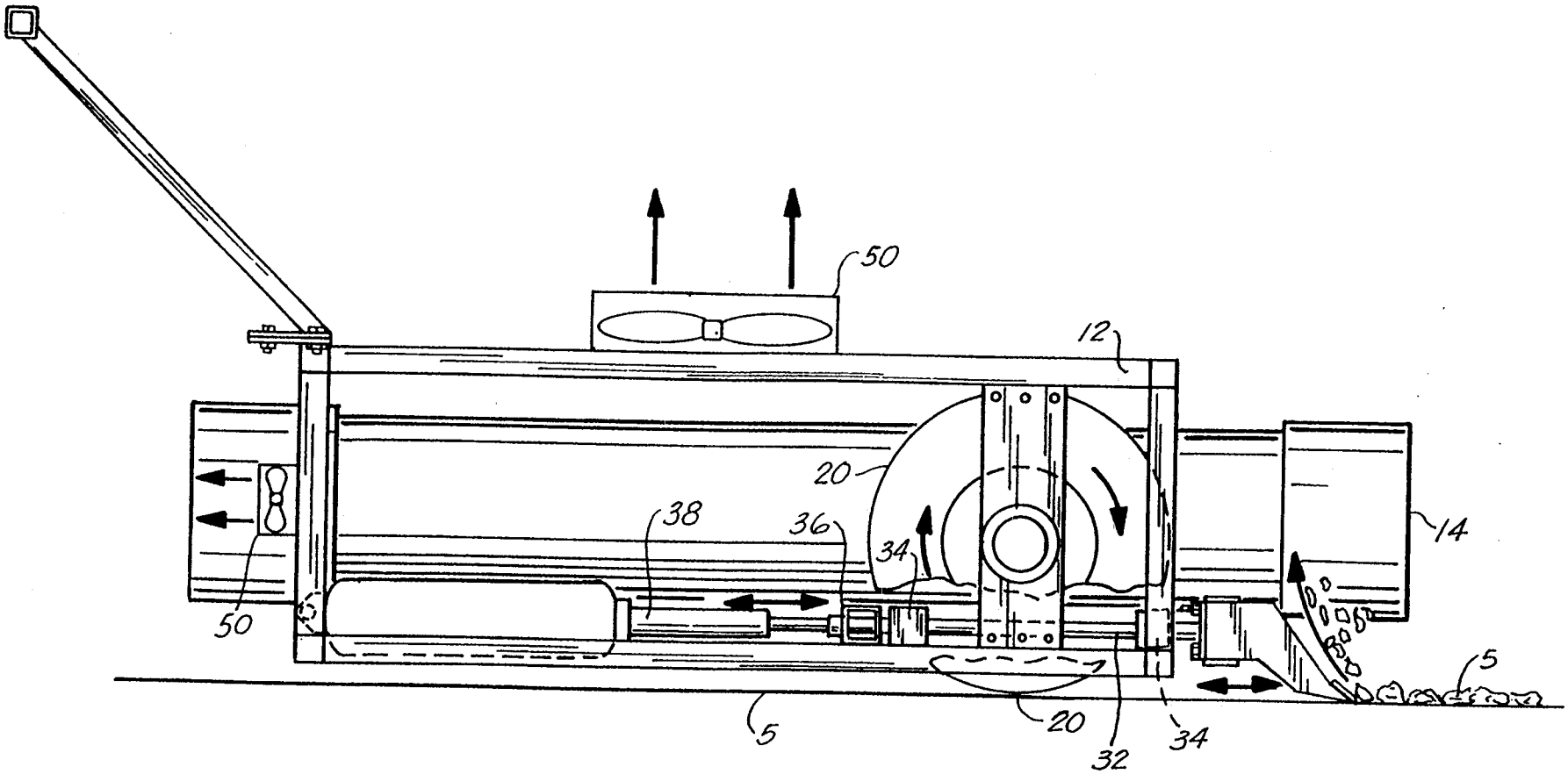
FIG. 4 is a side view of an alternate form of the apparatus having thrusters for motion.
Figure 5:
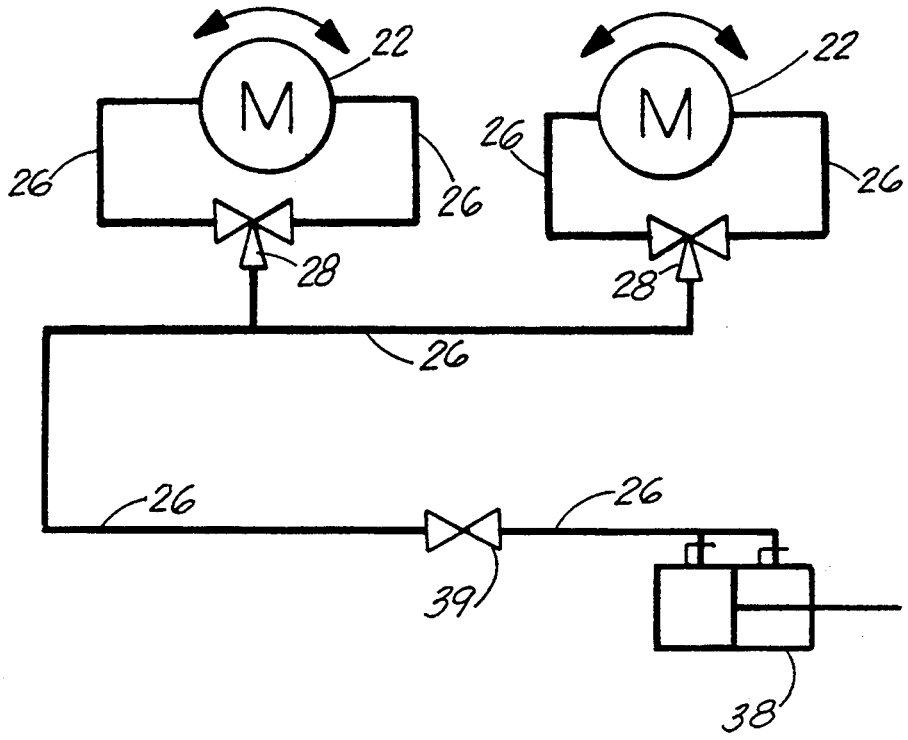
FIG. 5 is a schematic of the hydraulic motors and reciprocating piston of the apparatus, with controls and feed lines.

Referring to the figures, I show the innovative ship hull cleaner 10 comprising a substantially rectangular frame 12, preferably made of metal properly painted and coated for rust protection. FIG. 3 shows the ship hull cleaner 10 oriented as it is in the normal cleaning environment and directions such as up, down, forward and aft are in reference to this normal positioning for cleaning; it should, however, be apparent from the description that the invention is maneuverable under water, and during maneuvering may be rotated in any number of positions as is convenient for its submersion and positioning.

Along the upper outer side of the ship hull cleaner 10 are two parallel buoyancy tanks 14. These are essentially closed hollow metal tanks of typical buoyancy design, fed from a source of compressed air through air lines 16 which may run to either a self-contained compressed air cylinders (not shown) which may be optionally installed upon the frame 12, but, which more often are run back from the frame 12 to a tender vessel on the surface of the water. This use of a tending vessel to provide compressed air and power to the mechanism, as is known, significantly extends the time the mechanism can work without having to be resurfaced for recharging of compressed air and other stores.

Two forms of buoyancy tanks 14 may be provided in a first embodiment. Vents 18 are permanently opened provided on the underside of the buoyancy tank 14. In a second embodiment in the invention buoyancy vents 18 are closable valves, again provided periodically along the bottom of buoyancy tanks 14. The first embodiment is more flexible and reliable in that it eliminates the valves, a possible source of malfunction and eliminates the requirement for maintenance. However, it can be seen that when open holes are provided as the vents within the buoyancy tanks 14, the frame 12 must be maintained in a substantially level posture during operation of the ship hull cleaner 10. This is not normally a problem as standard ship design for commercial tankers and the like provide a substantially flat hull bottom. However, it is believed that there are circumstances in which the hull cleaning described below will be done at a more inclined angle due to the shape of the ship hull. If it is desired to have a form of the ship hull cleaner 10 which can be maintained at such an angle, valve control buoyancy vents 18 and drive positioning propellers 50, described below, should be utilized.

In the preferred embodiment, the bouyancy tanks 14 are designed for a maximum positive bouyancy of approximately twice the displacement weight of the cleaner 10. As an example, the prototype unit has a displacement weight of about 300 pounds, and the maximum bouyancy (tanks 14 fully blown) is 600 pounds. This provides for a positive upward force in use generally equal to the weight of the cleaner. It also permits the vents 18 to be positioned at the midline of the bouyancy tanks 14 and left open so that, when the cleaner 10 is lowered into the water nose down as shown in FIG. 3, the bouyancy tank 14 will flood halfway, producing netural bouyancy without the necessity of the operator venting or flooding the bouyancy tanks.

Extending above the upper level of the frame 12 of the ship hull cleaner 10 and well above the upper level of the buoyancy tanks 14 are two parallel drive wheels 20. Drive wheels 20 are fixed to the frame 12 and rotate about an axis transverse to the longitudinal direction of the frame 12. Each of the drive wheels 20 is directly driven by a drive motor 22 which may be either hydraulic drive motor or a pneumatic drive motor depending upon the desired power source to be provided from the surface tender.

Hydraulic drive has been found preferable by reason of its not venting large amounts of bubbles which would tend to obscure the work area and because it generally provides more power in a more compact form. Nonetheless, the use of hydraulic drive motors and controls are well understood in the art and it should be readily apparent how the hydraulic controls described below could be substituted for by electric, compressed air, pneumatic, or pneudraulic controls motors and the like.

Each of the wheels 20 is separately connected to an individually controlled drive motor 22. Each drive motor 22 is thence connected through hydraulic lines 26 to individual hydraulic controls 28. Hydraulic controls 28 are preferably reversing valves of a type well understood in the art for providing the driving fluid pressure to the drive motors either in a forward or reversed direction so that the drive motors 22 may be driven either in a forward or reverse direction with a center stop position. To the operator this is represented by a operating lever or actuator arm having three operative positions, in sequence: forward, off or reverse. Power to the hydraulic controls 28 is provided from the ship tender 55 through lines as is well understood in the underwater apparatus art.

Mounted ahead of the forward end of the frame 12 is transverse scraper blade 30. In shape, scraper blade 30 resembles an inverted bulldozer blade. It is a straight edged, substantially hardened metal bar having a curved or concave face, and a leading scraper edge which becomes the forward upper end of the ship hull cleaner 10. Scraper blade 30 is supported by two parallel drive support rods 32. These parallel rods are supported for sliding motion in trunion bearings 34 affixed to the frame 12 of the ship. The drive support rods 32 are connected in turn to a cross drive bar 36, which is directly connected to a hydraulic drive cylinder 38. Trunnion bearings 34 are any sliding bearing, usually in the form of sleeve bearings or bushings. Four such trunnion bearings 34 are typically used to provide for rigid alignment of the Drive support rods 32, and thus to maintain alignment of the scraper blade 30 with respect to the frame 12.

It should be noted that the scraper blade 30 is supported on parrallel, spaced drive rods 32 to provide for a division and balancing of the drive force on the blade 30. The irregular hull surface being cleaned, which results from the random distribution of barnicles, produces uneven impact loads on the scraper blade 30 which would tend to twist it; thus the parallel drive rods 32, each supported by two fixed turnnion bearings 34, maintain alignment of the scraper blade under these uneven forces. Thus the blade 30 is driven with balanced, reciprocating drive forces.

In a larger version of the apparatus, it may be desirable to provide two side-by-side scraper blades. This may be easily done by dividing the scraper blade 30 in two, and by mounting each blade 30 to a set of parallel drive rods 32 so that each set of parallel drive rods 32 straddles a drive wheel 20. In such an arraingement, there would be two independent drive cylinders 38. It would appear to be desirable to control these independent drive cylinders 38 so that their reciprocating action would be opposite for each other; as one blade advances the other withdraws.

Hydraulic drive cylinder 38 is a reciprocating hydraulic cylinder powered through an on/off control 39. Drive cylinder 38 is of the kind which provides a reciprocating stroke, preferably a 1½ to 2 inch stroke at a rate of 1200 cycles per minute. This reciprocating motion is communicated through the drive bar 36 evenly to the drive support rods 32, which are maintained parallel and balanced by trunnion bearing 34. Thus a balanced reciprocating force is applied to the scraper blade 30, which goes through an identical fore and aft stroke; in the example given, the blade would cycle through a 1½ inch to 2 inch stroke 1200 times per minute. The actual amount of travel and rate may vary fairly widely, but it has been found that a relatively short stroke, of generally less than about a foot, at a relatively high repetition rate, above several hundred strokes per minute, provides very efficient cleaning, but poses little risk of hull damage (due to the limited stroke distance, and the floating nature of the cleaner, which limits the maximum impact force of a scraper blade strike by the inertial resistance of its weight, and the limited force of its positive bouyancy). The high rate and short stroke is highly effective for scraping marine organisms which are small with respect to the size of the blade.

Descending downward from the aft end of the frame 12 is an optional diver support bar 40. This bar is of a length of three to four feet and terminates in a cross bar 42 at its lower aft end. When attached, it provides a convienient handle for the diver's manipulation of the cleaner 10, and provides a lever arm for manuvering the apparatus underwater.

Located on frame 12, typically adjacent the point of connection of diver support bar 40, are both hydraulic control bar 28 and the drive cylinder on/off controls 39. These controls are located to be in easy reach of the operating diver when the apparatus in in underwater use. It has been found that in turbid waters that the diver is better positioned directly under the apparatus so that he/she may better see the area being cleaned. The controls then may be mounted on the from 12 adjacent the lower forward part of the frame 12.

Drive motors 22 as installed are equipped, as is typical with hydraulic drive, with adjustment valves which may be preset to a particular drive rotational speed. The hydraulic control 28, as mentioned above, is in the form only of an on/off control; the speed of the drive motor 22 and thus the speed of the drive wheels 20 is predetermined and is not buried under water.

In use, the ship hull cleaner 10 is connected to a source of compressed air and hydraulic fluid on a surface tender vessel and then is lowered into the water, the buoyancy tanks 14 being flooded to achieve a slight negative buoyancy until the unit is submerged. A diver then maneuvers the unit underneath a ship hull and blows the ballast buoyancy tanks 14 to achieve a slight positive buoyancy.

During actual manipulation of the unit, the diver may take advantage of the lever arm provided by the diver support bar 40 for positioning of the unit while floating and submerged. Once the unit has obtained a positive buoyancy and is in contact with the ship hull, the diver may sit upon or stand upon the diver support bar 40. Alternatively, there may be no such support bar, or the diver may take a position directly underneath the cleaner 10, holding on to the lower, forward portion of the frame 12.

In either position, the diver finds it easy to manipulate the hydraulic controls 28 and on/off scraper blade control 39 while maintaining a clear view of the location and operation of the ship hull cleaner 10.

The ship hull cleaner 10, being brought to a positive buoyancy by blowing air into buoyancy tanks 14, rises against the ship hull 5 until contact is made by the drive wheels 20 and the scraper blade 30. Activation of the on/off control 39 drives the scraper blade in a fast, short reciprocating stroke, such as a 1½ to 2 inch stroke at 1200 cycles per minute. The ship hull cleaner 10 is then driven on a path along the ship hull 5 by individual activation of the hydraulic controls 28 which, by turning on or off or reversing the drive wheels 20, causes the ship hull cleaner 10 to move along the ship hull. The cleaner 10 may be turned by reversing the direction of one of the two drive wheels 20 and, may be backed up and redriven over a particularly difficult patch of barnacles and the like as may be readily seen.

It has been found that individually driven drive wheels 20 are sufficient to provide all necessary control to position and drive the ship hull cleaner 10 in any desired pattern for cleaning the ship hull 5.

It is further found that the short stroke high repetition rate scraping action of the scraper blade 30 produces a very rapid cleaning of the ship hull of barnacles and marine growth. Yet since this scraping impact is from a buoyantly floating cleaner adhering to the hull only by the combined forces of buoyancy and friction of the drive wheels 20, that no damaging impacts are imparted to the hull; the scraping action does not even normally chip or break protective paints and coatings.

Nonetheless, in actual use, the ship hull cleaner 10 has proven to be much faster in cleaning than the abrasive grinders or scrubber brushes of the prior art. It is practical, on even the largest of ocean going tankers, for a single diver with the unit 10 to clean the entire hull 5 of barnacle growth during typical port times while the ship is normally in demurrage. This results in no increase in down time for the ship owner with a consequent immense reduction in costs.

In an alternate form of the ship hull cleaner 10, a fixed downwardly acting thruster or drive positioning propeller 50 may be mounted centrally on the frame 12. This thruster provides an upward force approximately equivalent to the slight positive buoyancy of buoyancy tanks 14 permitting the hull cleaner 10 to be placed at an angle for cleaning the sides of a vessel or similar underwater surface. The thrust from the thruster 15 substitutes for the buoyancy and the buoyancy tanks 14 would then be brought to a neutral buoyancy.

It is clear that in such a condition the vents 18 of the buoyancy tanks 14 must be closable valves so as to prevent inadvertent venting or flooding of the buoyancy tanks 14 during maneuvering of the cleaner 10 at an angle. So long as a positive contact force is maintained between the ship hull cleaner 10 and the ship hull 5, whether by buoyancy from the buoyancy tanks 14 or by thrust from the positioning thruster 50, the interreaction of the drive wheels 20 and the scraper blade 30 is maintained and cleaning may be obtained as described above.

It is also possible to have a separate positioning thruster 52 mounted in the aft of the frame 12. This optional positioning thruster serves during maneuvering of the ship hull cleaner 10 by the diver to help thrust the ship hull cleaner forward so that it may readily positioned beneath a ship hull or returned to the tender.

While the positioning thruster 52 may speed the underwater positioning of the scraper, inasmuch as it is usually turned off during actual operation of the cleaner 10, it represents an additional item of complexity requiring maintenance, and thus it is not, at this time, considered to be a preferred installation on the ship hull cleaner 10.

It should be clear that the preferred embodiment described above for illustrative purposes is susceptible of several variations as have been listed; other variations in regards to the construction of buoyancy tanks, the frame, the positioning thrusters may be readily apparent to those skilled in the art. While it is considered that hydraulic or pneudraulic power is preferable in an underwater saltwater environment to electrical power it should also be apparent that an electrically powered cleaner is possible. Therefore, the invention is not limited to the specific illustrative preferred embodiment described above but rather extends to that range of these equivalents as are implicit in the claims.

I claim:

1. An apparatus for underwater cleaning of marine growth from a ship's hull comprising:

on a supporting frame:

buoyancy tanks having a variable buoyancy;

means for traversing the apparatus on a directed path along a ship hull in contact with said hull;

a scraper blade, supported for reciprocating motion solely in the direction of said directed path on the frame, without motion into or away form said hull; and means for reciprocating the scraper blade fore and aft motion with respect to the frame for a relatively short stroke at a high repetition rate.

2. The apparatus of claim 1 wherein said short stroke comprises a distance of less than one foot.

3. The apparatus of claim 1 wherein said high rate comprises a rate of above several hundred strokes per minute.

4. The apparatus of claim 1 wherein said short stroke comprises a distance of about one and one half to two inches.

5. The apparatus of claim 1 wherein said high rate comprises a rate of about Twelve hundred strokes per minute.

6. An apparatus for cleaning ship hulls comprising:

a blade;

means for reciprocating said blade for a relatively short fore and aft stroke at a high repetition rate;

means for traversing said blade while reciprocating along a path in contact with said ship hull underwater.

7. The apparatus of claim 6 wherein said short stroke comprises a distance of less than one foot.

8. The apparatus of claim 6 wherein said high rate comprises a rate of above several hundred strokes per minute.

9. The apparatus of claim 6 wherein said short stroke comprises a distance of less than one foot; and said high rate comprises a rate of above several hundred strokes per minute.

10. The apparatus of claim 6 wherein said short stroke comprises a distance of about one and one half to two inches.

11. The apparatus of claim 6 wherein said high rate comprises a rate of about Twelve hundred strokes per minute.

12. The apparatus of claim 6 wherein said means for traversing comprises:

a frame supporting said blade and said means for reciprocating:

means for urging said frame against said ship hull;

means for driving said frame along a path on said hull.

13. The apparatus of claim 12 wherein said means for urging comprises:

buoyancy tanks on said frame having a varible buoyancy for urging said apparatus into contact with the hull underwater.

14. The apparatus of claim 13 wherein said means for driving comprises:

at least two tires extending above said frame in contact with said hull;

means for independently driving said tires.

15. The apparatus of claim 13 wherein said means for driving comprises:

a thruster mounted on said frame.

* * * * *